US006439317B1

(12) United States Patent
Minotti et al.

(10) Patent No.: US 6,439,317 B1
(45) Date of Patent: Aug. 27, 2002

(54) DEVICE FOR BREAKING CONCRETE

(75) Inventors: L. Marcello Minotti, Houston, TX (US); Steven S. Easley, Tulsa; Leon R. Walker, Claremore, both of OK (US)

(73) Assignee: Minotti Equipment & Manufacturing, L.L.C., Houston, TX (US)

( * ) Notice: Subject to any disclaimer, the term of this patent is extended or adjusted under 35 U.S.C. 154(b) by 0 days.

(21) Appl. No.: 09/521,478

(22) Filed: Mar. 8, 2000

(51) Int. Cl.[7] ..... B25D 9/00

(52) U.S. Cl. ..... 173/89; 173/11; 173/206; 173/84; 173/115; 299/37.4

(58) Field of Search ..... 173/206, 207, 173/89, 86, 184, 115, 28, 4, 11, 84, 114, 113; 404/90, 133.05, 133.1; 299/37.4

(56) References Cited

U.S. PATENT DOCUMENTS

| | | | | |
|---|---|---|---|---|
| 2,659,583 A | | 11/1953 | Dorkins | |
| 3,658,139 A | | 4/1972 | Von Ruden | |
| 4,050,526 A | * | 9/1977 | Deike | 173/115 |
| 4,429,751 A | * | 2/1984 | Jackson et al. | 173/13 |
| 4,439,056 A | | 3/1984 | Reilly et al. | |
| 4,634,311 A | | 1/1987 | Jinnings et al. | |
| 4,852,661 A | * | 8/1989 | Ellington | 173/84 |
| 4,977,965 A | * | 12/1990 | Rupe | 173/89 |
| 5,012,873 A | | 5/1991 | Kennedy et al. | |
| 5,168,937 A | * | 12/1992 | Hamner | 173/4 |
| 5,291,955 A | | 3/1994 | Clark | |
| 5,490,740 A | | 2/1996 | Johnson | |
| 5,529,132 A | * | 6/1996 | Evarts | 173/115 |
| 5,607,022 A | | 3/1997 | Walker et al. | |

* cited by examiner

*Primary Examiner*—Scott A. Smith
(74) *Attorney, Agent, or Firm*—Fellers, Snider, Blankenship, Bailey & Tippens, P.C.

(57) ABSTRACT

The present invention provides a device for breaking up a paved surface which attaches to a host transport, such as a skid steer or backhoe, having a hydraulic power supply and preferably comprises a closed hydraulic system which includes a regenerative and concentric type double hydraulic cylinder arrangement adjustably supported within a vertical frame. The cylinder is operably attached to a weight such that when fluid is pumped into a first chamber, a piston drives a rod, thereby lifting a weight while at the same time, the piston forces hydraulic fluid from a second chamber to the host. The piston separates the first chamber from the second chamber within the cylinder. Upon reaching a prescribed height, a valve is opened, allowing fluid to flow from the first chamber into the second chamber, thereby allowing the weight to drop rapidly under the influence of gravity. The inventive device for breaking a paved surface includes an adjustment system for adjusting the vertical position of the cylinder within the frame and a system for preventing operation of the device unless it is properly positioned above the surface for breaking.

15 Claims, 12 Drawing Sheets

DEVICE FOR BREAKING CONCRETE

BACKGROUND OF THE INVENTION

1. Field of the Invention

This invention relates generally to devices for breaking concrete. More particularly, but not by way of limitation, the present invention relates to a drop hammer for breaking concrete, asphalt, etc. which is mounted to a skid steer or back hoe.

2. Background

When paved surfaces such as roadways or parking lots are in need of repair or resurfacing, there is often a need to break up the existing surface for removal. In the past, this has been accomplished with specialized and dedicated equipment. These dedicated pieces of equipment typically require a substantial investment and are limited to the single task of breaking up a surface.

Previous devices, such as the one disclosed in U.S. Pat. No. 5,607,022 ("the '022 patent") have been developed which attach to existing equipment such as a skid steer. These devices reduce the equipment cost but have exhibited limitations in their performance. For example, the device disclosed in the '022 patent uses a hydraulic cylinder to lift a weight wherein hydraulic fluid is first pumped from a reservoir into the hydraulic cylinder causing the cylinder rod to extend. When the weight reaches a preselected height, a trip switch is activated which opens a dump valve thereby allowing fluid to flow from the hydraulic cylinder back into the reservoir as the cylinder rod is retracted by the falling weight. Unfortunately, the rate at which the weight falls is limited by restrictions on the flow of the hydraulic fluid from the hydraulic cylinder to the reservoir. The flow rate is thus limited by factors such as the diameter and length of the hydraulic lines, some of which are integral to the skid steer. In particular, the hydraulic return line of the skid steer which returns hydraulic fluid to the reservoir often proves to be the limiting factor in determining the drop rate of the weigh. Accordingly, unless a separate hydraulic system is employed, requiring a pump, motor, reservoir, and cooling system, the drop rate is limited by factors which are outside of the control of the supplier of the breaker. A need, therefore, exists for a hydraulic system for a concrete breaker which will support the flow rate of hydraulic fluid necessary to achieve a satisfactory drop rate of the weight, independent of the flow rate sustainable by the skid steer and without substantial additional hydraulic subsystems.

In addition, the hydraulic system disclosed in the '022 patent is not a closed system. As the cylinder is filled to lift the weight, fluid is drawn from the reservoir, and, conversely, as the weight falls and the cylinder is emptied, fluid is returned to the reservoir. Obviously, the reservoir must be able to accommodate these fluctuations in the volume of fluid stored within the reservoir. This is typically accomplished by venting the reservoir to the atmosphere. Venting in a cyclic hydraulic system, such as the system typically employed in a breaker, causes air to continuously be drawn in to, and subsequently expelled from, the reservoir. This is of particular concern at a construction site where the air may have a relative high concentration of dust and other particulate matter as is usually the case where the existing pavement is being broken and removed. A need also exists, therefore, for a concrete breaker which does not require a reservoir, or if a reservoir is already present on the skid steer, minimizes fluctuations in the fluid level in the reservoir during operation of the breaker.

Finally, there often exists a need to transport, and even operate, a concrete breaker where overhead obstructions are a concern. Previous devices have typically been of a fixed height. Accordingly, a need exists for a concrete breaker wherein the overall height of the device may be adjusted downward for transportation or operation in vertically confirmed spaces, or adjusted upward for more effective operation in spaces where overhead clearance is not a concern.

SUMMARY OF THE INVENTION

The present invention provides a device for breaking up a paved surface which satisfies the needs and alleviates the problems discussed above. The inventive apparatus attaches to a host, such as a skid steer or backhoe, having a hydraulic power supply and preferably comprises a closed hydraulic system which includes a regenerative type hydraulic cylinder arrangement adjustably supported within a vertical frame. The cylinder is operably attached to a weight such that when fluid is pumped into a first chamber from the host, a piston disposed between the first chamber and a second chamber drives a rod, thereby lifting a weight. At the same time, the piston forces hydraulic fluid from the second chamber back to the host. Upon reaching a prescribed height, a valve is opened, allowing fluid to flow from the first chamber into the second chamber on the other side of the piston, thereby allowing the weight to drop rapidly under the influence of gravity. This is an important aspect of the present invention because the required volumetric flow rate is very large to allow the weight to fall freely. The rapid flow of fluid from the first chamber into the second chamber is a function of the above described structure of the inventive device and is thus independent of the diameter and length of hydraulic lines provided on the skid steer. A tool attached to the weight strikes the paved surface at the bottom of travel of the weight, breaking up the surface.

Since hydraulic fluid is forced from the second chamber by the piston as fluid is pumped into the first chamber, and likewise, since fluid forced from the first chamber, as the weight falls, fills the second chamber, the volumetric rate of fluid drawn from or returned to a reservoir is reduced to within the host's operating range.

The regenerative concentric type double hydraulic cylinder arrangement includes a threaded cylindrical outside surface which receives an adjustment nut wherein the vertical position of the cylinder relative to the frame may be adjusted. The overall height of the inventive device may be adjusted to a relatively low position for transportation or operation where overhead clearance is a concern or adjusted to a higher position for more effective breaking where no such concern exists.

It is thus an object of the present invention to provide a device for a breaking up a paved surface which may be attached to existing equipment such as a skid steer or backhoe.

It is a further object of the present invention to provide a device for breaking up a paved surface which incorporates a regenerative double hydraulic cylinder arrangement wherein restrictions in the flow of hydraulic fluid while a weight is dropped, are substantially independent of the hydraulic system of the host skid steer or backhoe thereby allowing the weight to fall at a higher rate than achieved by previous devices.

It is still a further object of the present invention to provide a device for breaking up a paved surface which utilizes a closed hydraulic system such that a reservoir and other necessary related subsystems my be eliminated or, if a reservoir is present, fluctuations in the amount of fluid in the reservoir are reduced to an insignificant level.

It is yet a further object of the present invention to provide a device for breaking up a paved surface wherein the position of the hydraulic cylinder relative to the frame is adjustable to accommodate a variety of operating conditions and to improve transportability of the inventive device.

Further objects, features, and advantages of the present invention will be apparent to those skilled in the art upon examining the accompanying drawings and upon reading the following detailed description of the preferred embodiments.

DETAILED DESCRIPTION OF THE PREFERRED EMBODIMENT

Figure 1:
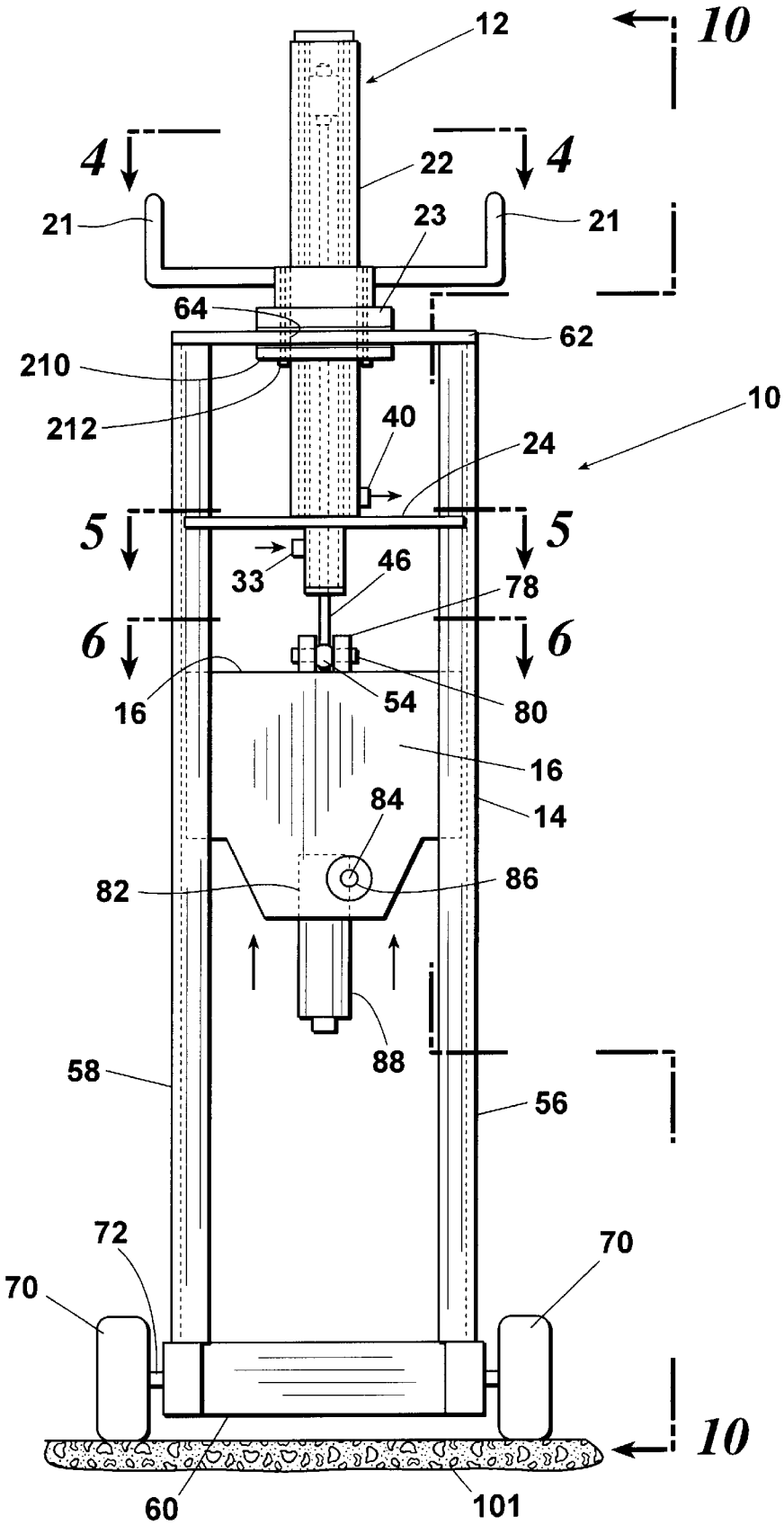
FIG. 1 is an elevational front view of a preferred embodiment 10 of the inventive device for breaking a paved surface showing the weight in a lifted position.

A preferred embodiment 10 of the inventive device for breaking concrete is shown in FIGS. 1–11 and 16–18. As best seen in FIG. 1, the device for breaking concrete 10 comprises: cylinder assembly 12; vertical frame 14 supporting cylinder assembly 12; weight 16 slidably retained in and capable of vertical travel within frame 14; closed hydraulic system 18 (FIG. 8); and mounting bracket 22 (FIG. 9) for attaching the inventive device to a suitable host 20, preferably a skid steer or backhoe.

As used herein, the term "breaker" refers to the inventive device for breaking concrete 10

Figure 3:
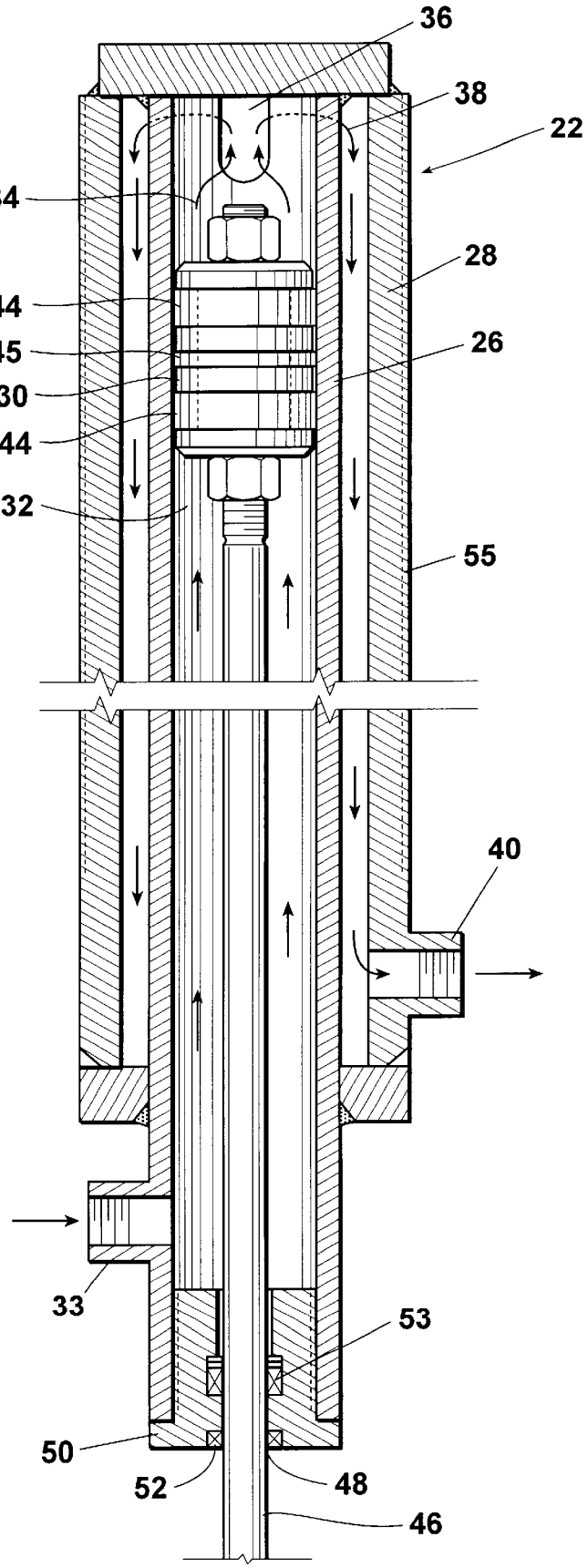
FIG. 3 is a cutaway view of concentric type double hydraulic cylinder 22 incorporated in the inventive device for breaking a paved surface.
Figure 4:
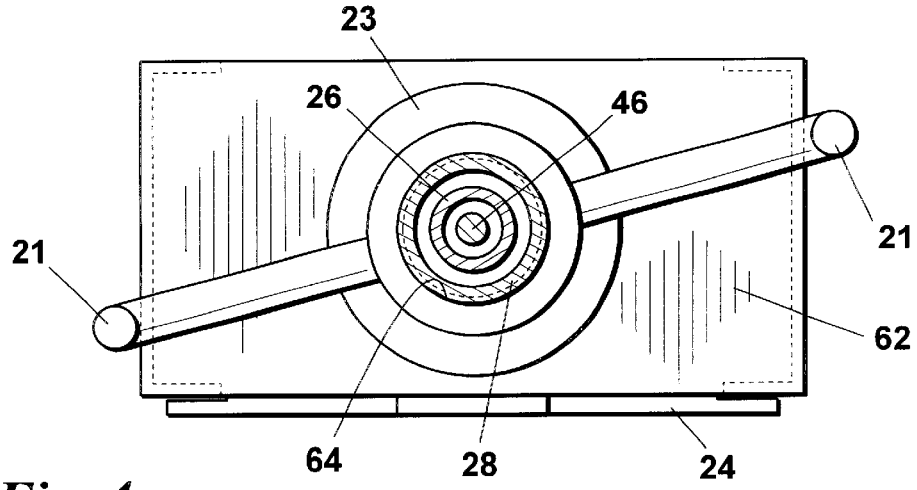
FIG. 4 is an elevational top view of the concentric type double hydraulic cylinder 22 and adjustment nut 23 incorporated in the inventive device for breaking a paved surface.

As is best seen in FIG. 3, in the preferred embodiment 10, cylinder assembly 12 includes a concentric type double hydraulic cylinder 22 in a regenerative circuit arrangement (described below), adjustment nut 23, and cylinder retainer 24. As is shown, cylinder 22 is of a double "cylinder within a cylinder" arrangement wherein the inner cylinder 26 and outer cylinder 28 are arranged in a concentric fashion for manufacturing and fluid flow convenience. However, it is understood by those of skill in the art that inner cylinder 26 may be positioned in an eccentric arrangement with respect to the outer cylinder 28 while still being in a double cylinder arrangement without departing from the scope of the invention.

Figure 7:
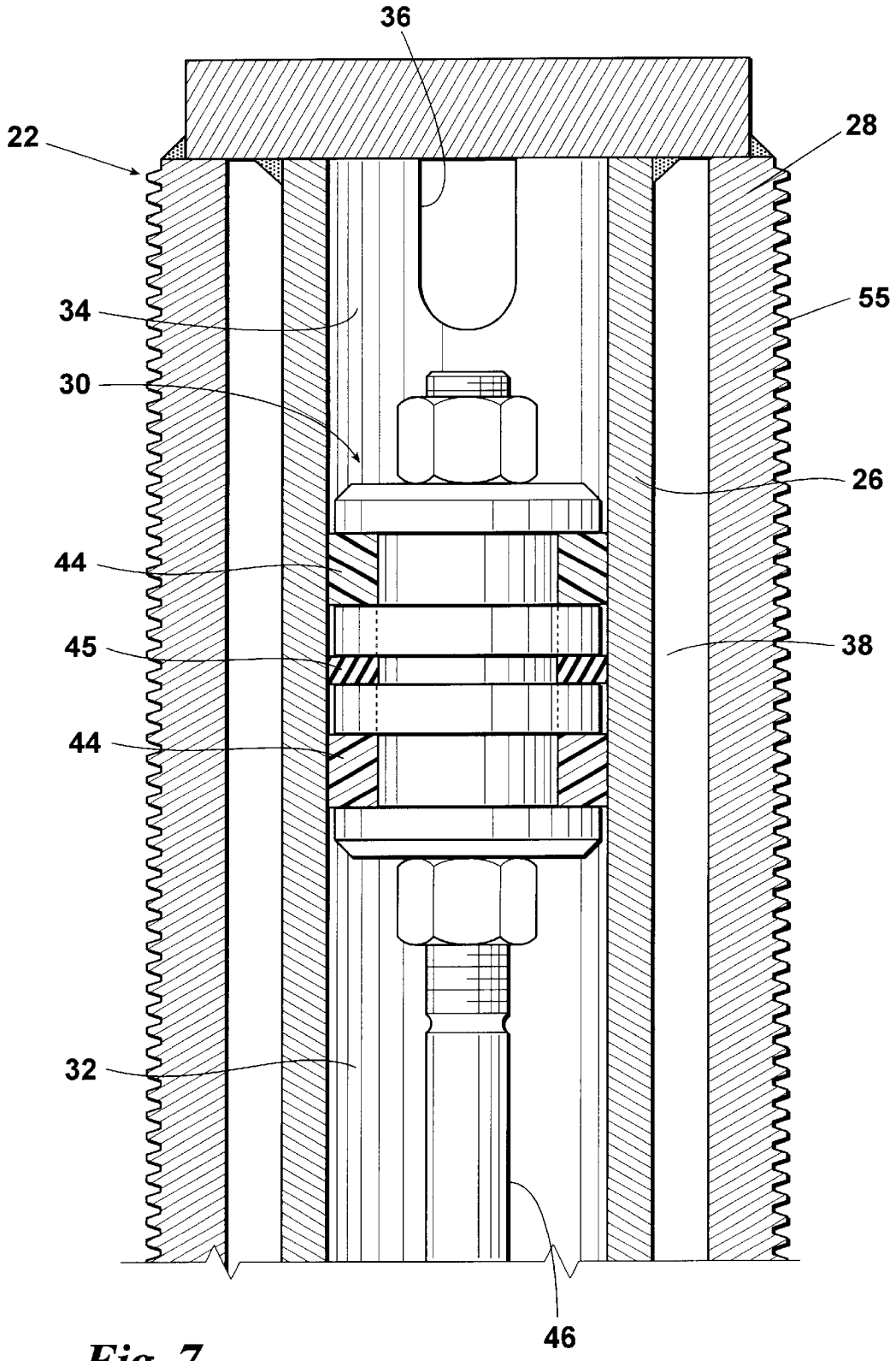
FIG. 7 is a cutaway detail of the concentric type double hydraulic cylinder 22 showing the outside threaded surface thereof.

As best seen in FIG. 3 taken in combination with FIG. 7, double cylinder 22 has inner cylinder 26 partially contained in outer cylinder 28. Inner cylinder 26 houses piston 30 such that first chamber 32 and second chamber 34 are created respectively below and above piston 30. FIG. 3 shows the hydraulic fluid flow pattern for a lifting mode wherein piston 30 is forced by hydraulic fluid pressure within first chamber 32 toward second chamber 34.

Inner cylinder 26 includes port 36 towards its upper end which allows fluid to freely flow bidirectionally between second chamber 34 and annular gap 38 located between outer cylinder 28 and inner cylinder 26. A threaded port 40 receives a fitting on a hydraulic line and is provided at the lower end of outer cylinder 28 to provide a path for hydraulic fluid to flow into and out from (as shown in FIG. 3) gap 38. As will be shown herein below, advantages are realized by providing port 40 at the lower end of outer cylinder 28. Threaded port 33, providing fluid access to first chamber 32, is located at the lower end of inner cylinder 26.

It is a characteristic of first chamber 32 and second chamber 34 that their respective volumes vary depending on the position of piston 30 such that as piston 30 moves upward, first chamber 32 will increase in volume while second chamber 34 decreases proportionately in volume. Conversely, when piston 30 moves in the downward, first chamber 32 decreases in volume while second chamber 34 proportionately increases in volume.

Regenerative, in regards to hydraulic cylinder 22, refers to a hydraulic circuit arrangement wherein, as the cylinder rod extends under the influence of a falling weight, fluid is forced from the first chamber 32 into second chamber 34 with minimum involvement of any hydraulic system elements located external to the breaker 10. First chamber 32 is thus in direct fluid communication with second chamber 34.

Furthermore, it will be apparent to those skilled in the art that if, during the dropping cycle, the hydraulic pressure in first chamber 32 is the same as the hydraulic pressure in second chamber 34, there will be a net force pushing downward on rod 46. This results from the fact that the pressure in second chamber 34 acts over a larger surface area of the piston 30 than does the pressure in first chamber 32 due to the area taken up by rod 46.

Piston 30 preferably includes at least one rider band 44 (two shown in the preferred embodiment) which prevents excessive rubbing between piston 30 and inner cylinder 26 and seal 45 which prevents hydraulic fluid from undesirably leaking between first chamber 32 and second chamber 34. Rod 46 is connected to piston 30 and extends through aperture 48 in cylinder gland cap 50 of cylinder 22. Cap 50 houses wiper bushing 52 and gland seal 53 about aperture 48 which prevent hydraulic fluid from leaking between aperture 48 and rod 46. Clevis 54 (FIG. 1) is operably (threadedly) engaged to the end of rod 46 opposite piston 30. In the preferred embodiment, clevis 54 is a ball joint clevis.

Preferably, as also shown in FIGS. 7 and 1, the outside surface 55 of outer cylinder 28 is provided with an Acme screw thread to receive adjustment nut 23, such that nut 23 may be selectively positioned along the length of outer cylinder 28. This selective positioning controls the drop height of weight 16 (FIG. 1).

Figure 5:
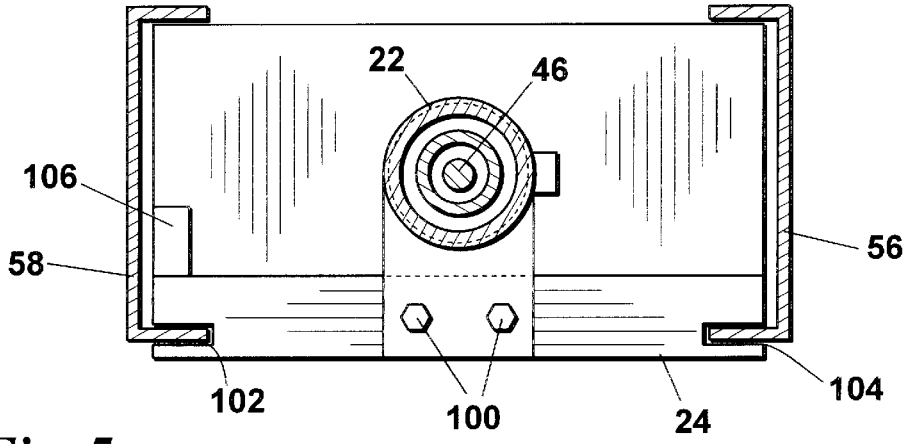
FIG. 5 is an elevational top view of the concentric type double hydraulic cylinder 22 and cylinder retainer 24 incorporated in the inventive device for breaking a paved surface.

Referring next to FIG. 5, cylinder retainer 24 attaches to cylinder 22 with bolts 100. Retainer 24 is slidably received within frame 14 such that left slot 102 receives left upright channel 56 and right slot 104 receives right upright channel 58 of frame 14. Retainer 24 prevents cylinder 22 from turning when nut 23 is rotated.

Referring once again to FIG. 1, the components of frame 14 shall be described. Frame 14 comprises left upright channel 56 and right upright channel 58 connected between top plate 62 at the upper end and base 60 at the lower end such that upright channels 56 and 58 are substantially vertical and parallel.

Figure 10:
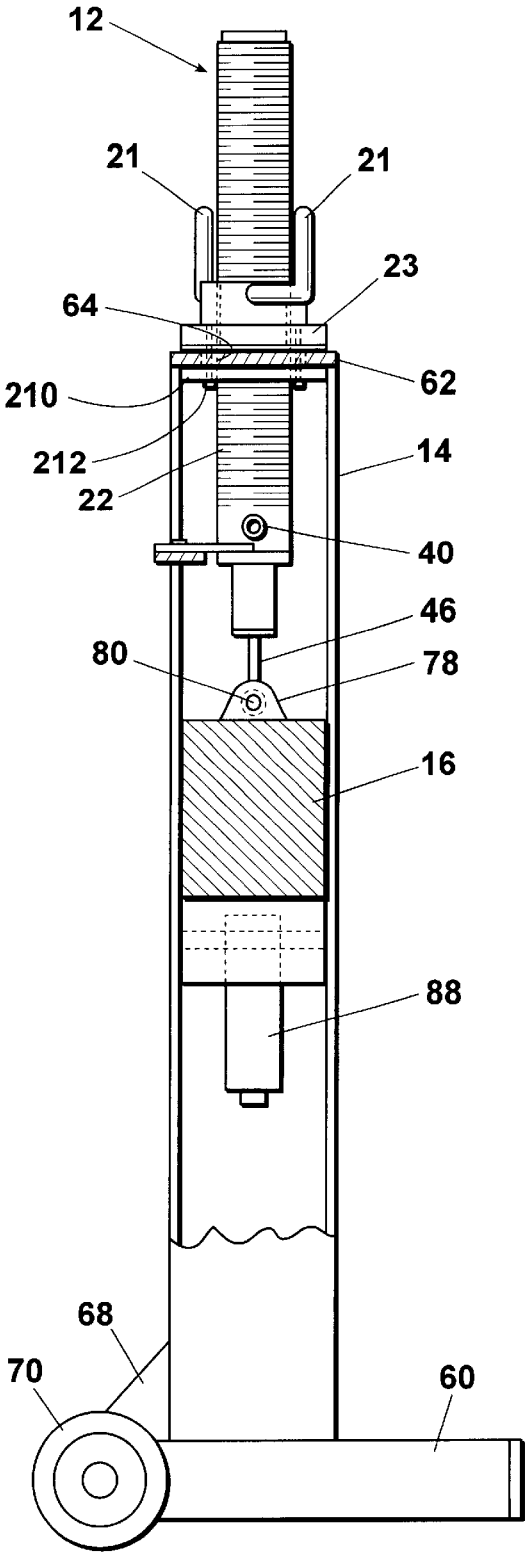
FIG. 10 is an elevational side view of the device for breaking a paved surface shown with the regenerative type double hydraulic cylinder 22 shown adjusted to a first position.
Figure 11:
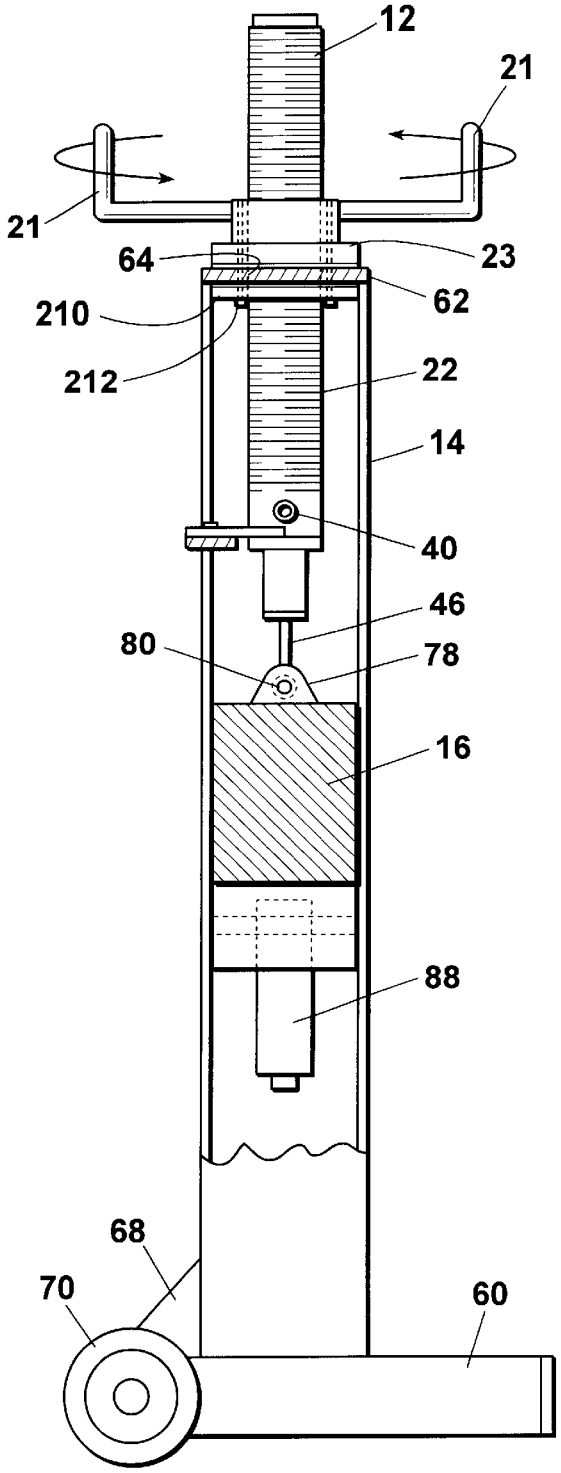
FIG. 11 is an elevational side view of the device for breaking a paved surface shown with the regenerative type double hydraulic cylinder 22 shown adjusted to a second, lower position.

Flange 210 is attached to adjustment nut 23 with bolts 212 to sandwich top 62 and locate nut 23 about aperture 64. When assembled, hydraulic cylinder 22 is threadedly received in nut 23, passing through flange 210 and aperture 64. Flange 210 below plate 62 cooperates with adjustment nut 23 above plate 62 to prevent unwanted vertical movement of the hydraulic cylinder 22 during times when the hydraulic fluid pressure in inner cylinder 32 exerts some downward force on rod 46. As shown in FIGS. 10 and 11, the vertical position of the cylinder assembly 12 relative to frame 14 may be adjusted by turning adjustment nut 23 using handles 21 to position nut 23 at the appropriate position along the length of cylinder 22.

In the preferred embodiment, the range of adjustment for cylinder 22 provides a drop height range between 1 inch and 47 inches. Port 40 is located at the lower end of cylinder 22 to allow nut 23 to be threaded over the top of cylinder 22 and to place mating hydraulic lines below top plate 62. Port 40 could be located on the top of cylinder 22 which may eliminate the need for the concentric type double hydraulic cylinder, however, a cumbersome pipe is required, i.e. large enough to allow the volume of hydraulic fluid to evacuate the cylinder without restricting the drop rate of the piston (and therefore the weight). Such a pipe may obstruct adjustment nut handles 21. Accordingly, there are no pipes or hydraulic lines extending above top plate 62 (or the portion of cylinder 22 extending above top plate 62) in the preferred embodiment.

Figure 17:
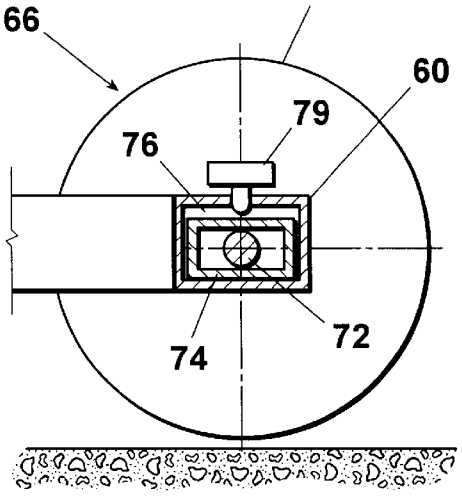
FIG. 17 is a cutaway side view showing the weight-on-wheels switch 79 in a non-actuated state as incorporated in the inventive device for breaking a paved surface.
Figure 18:
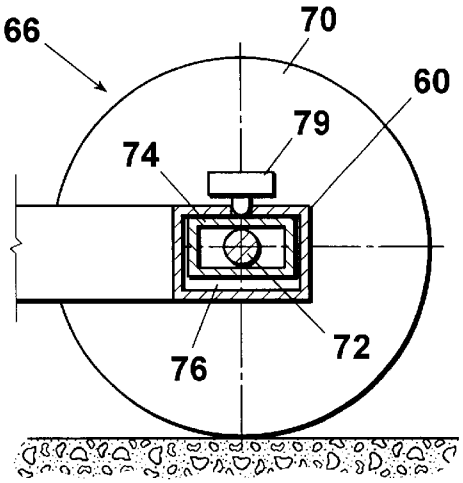
FIG. 18 is a cutaway side view showing the weight-on-wheels switch 79 in an actuated state as incorporated in the inventive device for breaking a paved surface.
Figure 16:
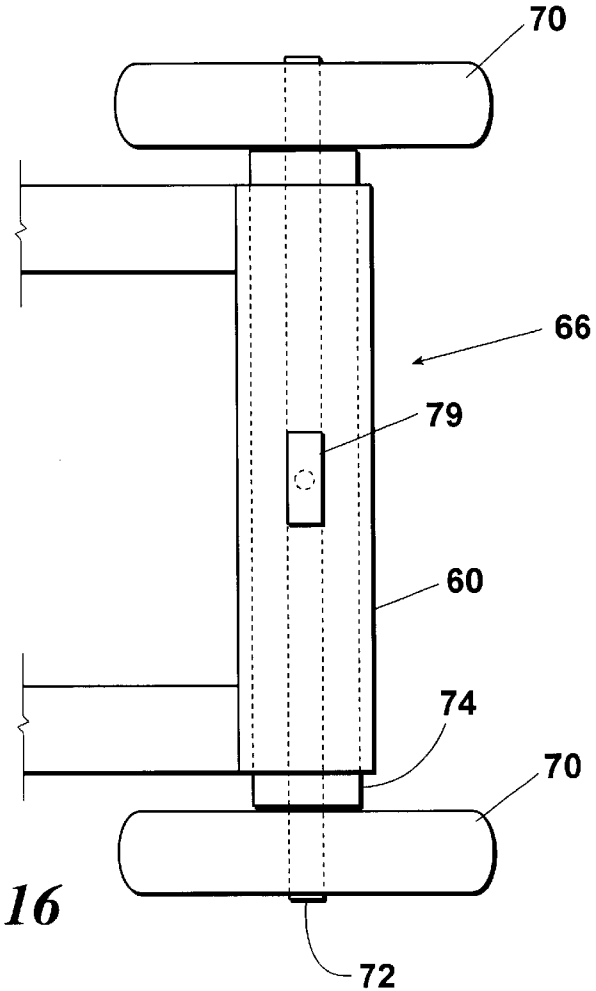
FIG. 16 is an elevational top view of the base 60 of the device for breaking a paved surface.

As best seen in FIGS. 10, 11, and 16, base 60 is connected to the lower ends of upright channels 56 and 58 and a gusset 68 is attached between base 60 and each upright channel 56 and 58. As shown in FIGS. 16–18, ground contacting mechanism 66 is housed in base 60 and comprises wheels 70 rotatably attached to wheel spindle 72 which is retained in axle carrier 74. Axle carrier 74 passes through rectangular passageway 76 provided in base 60. Weight-on-wheels switch 79 is provided to indicate when breaker 10 is in its proper operating position, near the ground, preferably within three inches of the ground. Switch 79 is mounted on base 60, extending from the top of base 60 into passageway 76 such that as the inventive breaker 10 nears the ground, the axle carrier 74 moves upward towards the upper surface of passageway 76 thereby actuating switch 79. This position is depicted by FIG. 18. Conversely, as the breaker 10 moves away from the ground, axle carrier 74 moves towards the lower surface of passageway 76 and switch 79 is not actuated. This position is depicted by FIG. 17.

Figure 6:
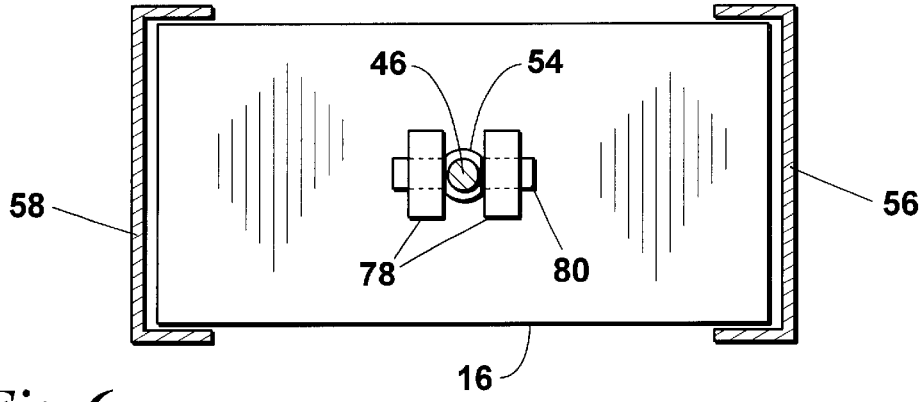
FIG. 6 is an elevational top view of the weight 16 and clevis 54 incorporated in the inventive device for breaking a paved surface.

Referring next to FIG. 6, weight 16 is slidably retained for vertical movement between left upright channel 58 and right upright channel 56 (as viewed by the operator). Bracket 78 is provided on the top of weight 16 to pivotally attach weight 16 to clevis 54 with clevis pin 80. As stated above, clevis 54 is a ball joint clevis in the preferred embodiment, however, other known clevis or ball joint constructs could be substituted. Weight 16 is thus operably engaged to rod 46 and is raised and lowered in response thereto.

Referring again to FIG. 1, tool receptacle 82 provided on the bottom of weight 16 includes aperture 84 which receives pin 86 to removably retain tool 88 within tool receptacle 82. In the preferred embodiment, the combined weight of weight 16 and tool 88 is approximately one thousand pounds, however, it will be obvious to those skilled in the art that a wide range of weights may be employed depending on the size of the host machine and the thickness of the concrete, asphalt, or other desired material to be broken.

Figure 8:
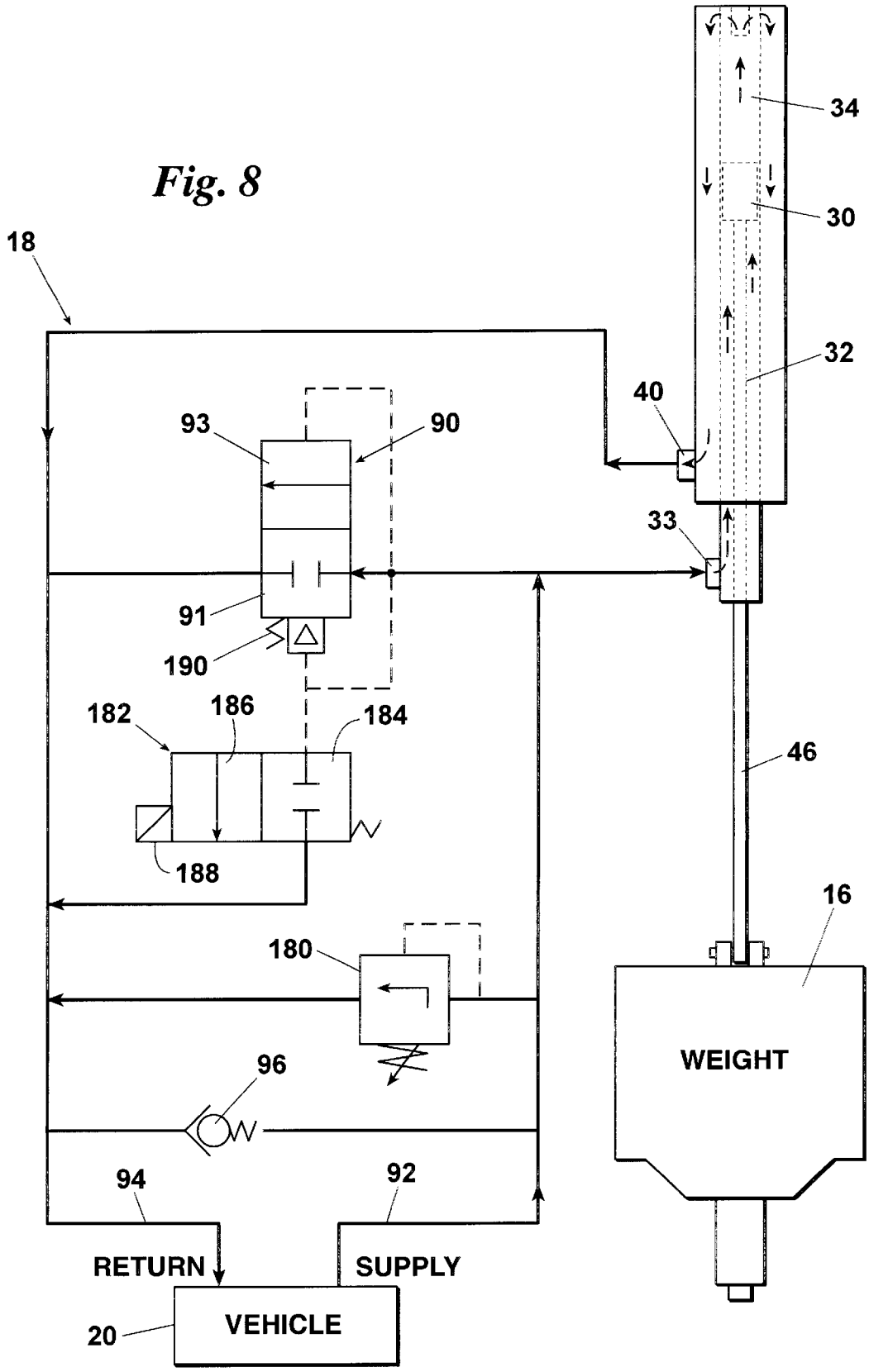
FIG. 8 is a hydraulic schematic diagram for the closed hydraulic system 18 incorporated in the inventive device for breaking a paved surface.
Figure 9:
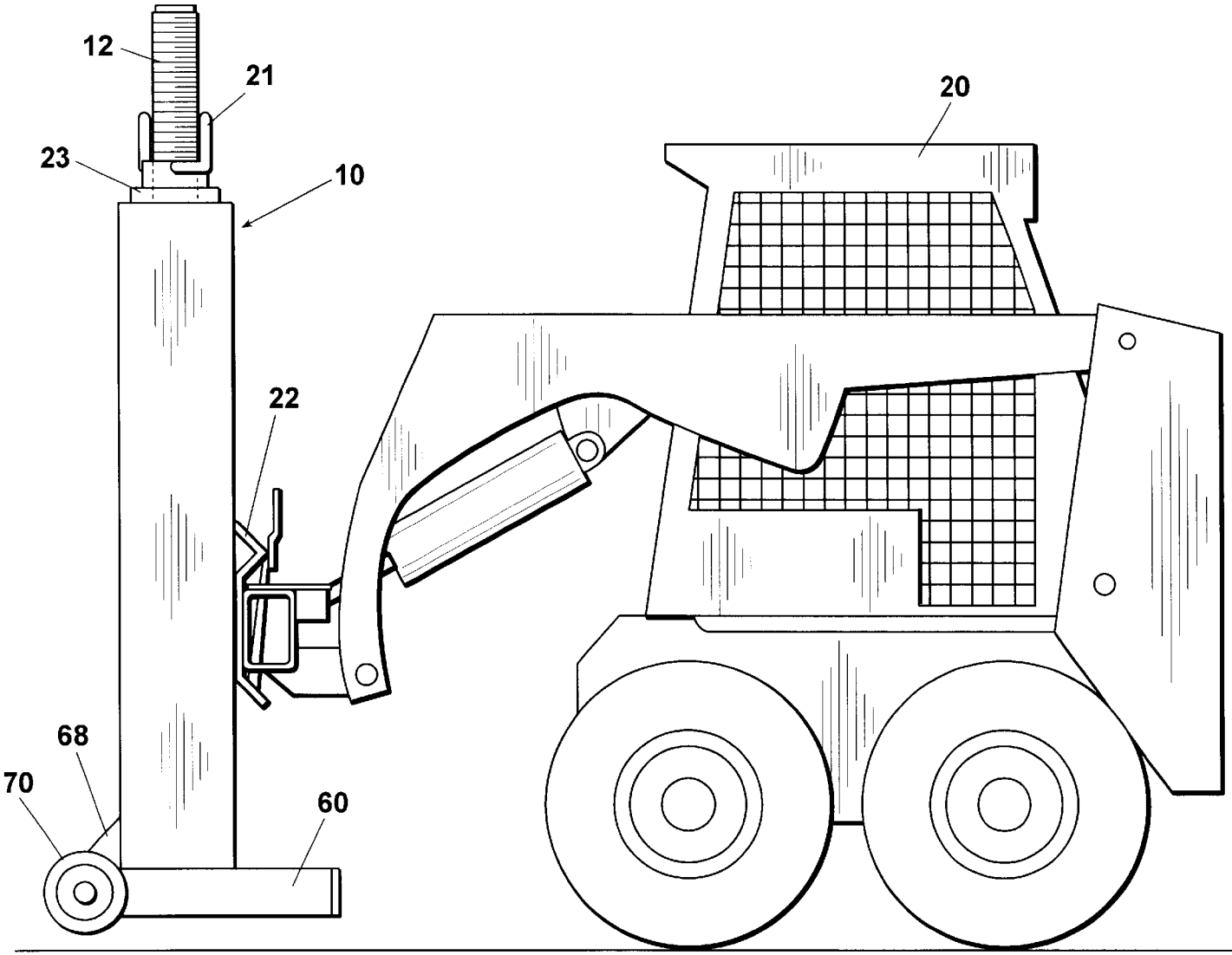
FIG. 9 is an elevational side view showing the general environment of the device for breaking a paved surface.

The closed hydraulic system 18, as shown in FIG. 8, includes first chamber 32 and second chamber 34 described hereinbefore, hydraulic power source 18 which is preferably integral to the host equipment 20 (FIG. 9), valve 90 having a closed position and an open position, actuator 182 for operation of valve 90, supply line 92, return line 94, and one-way check valve 96 which precludes operation of the inventive breaker 10 if the supply line 92 and return line 94 are inadvertently reversed or the operator reverses the direction of flow.

Figure 19:
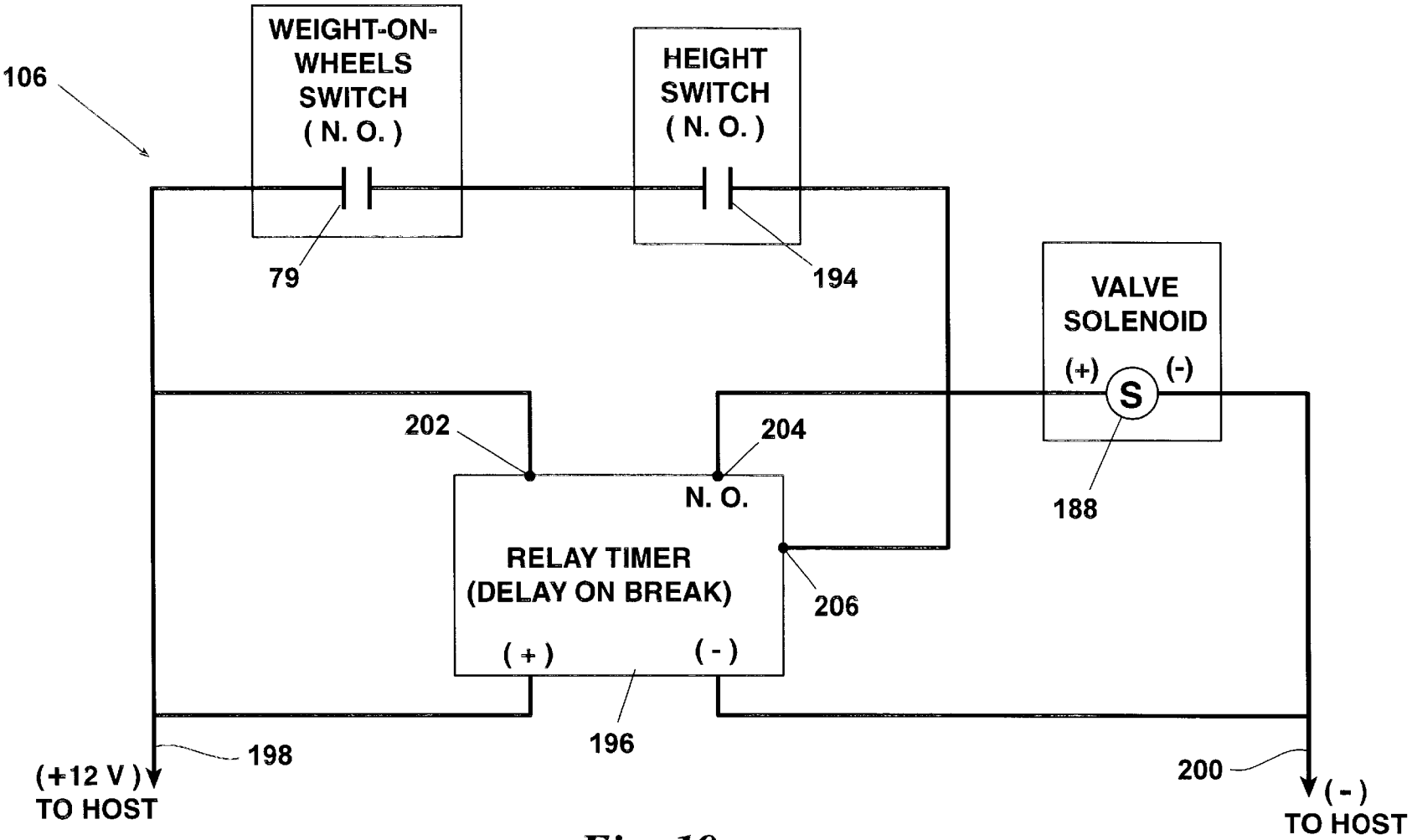
FIG. 19 is an electrical diagram of the timer circuit 106 of the present invention.

Actuator 182 is an electrically operated valve to control the flow of hydraulic fluid from valve 90 which is hydraulically operated. As can be seen, actuator 182 has a closed position 184 and an open position 186. A solenoid 188 positions actuator 182 between closed position 184 and open position 186 in response to an electrical signal from timer circuit 106 (FIG. 19). When electricity is sent to solenoid 188 from timer circuit 106, actuator 182 moves from closed position 184 to open position 186. When actuator 182 is in open position 186, the hydraulic fluid pressure drops in dump valve 90. In response to this pressure drop, spring 190 moves dump valve 90 from its closed position 91 to its open position 93. When dump valve 90 opens, hydraulic fluid flows unrestricted and rapidly from first chamber 32 through port 33 through valve 90 and into second chamber 34 thereby allowing piston 30 (and thereby weight 16) to drop freely (unrestricted) within first chamber 32.

The hydraulic system does not require a vented reservoir, or, if the host equipment has a vented reservoir, the amount of fluid stored in the reservoir is kept relatively constant, as the breaker 10 is operated, to substantially reduce venting, and thus the hydraulic system is referred to as a closed system.

Closed hydraulic system 18 also includes a relief valve 180. Relief valve 180 protects hydraulic system 18 from overpressure and is designed to allow hydraulic fluid to escape directly from the supply line 92 to the return line 94 in such a situation.

Reference is next made to FIG. 19 which shows an electrical diagram for timer circuit 106 of the present invention. Electrical power is supplied by the host vehicle in a conventional manner through positive cable 198 and negative cable 200.

Weight-on-wheels switch 79 and height trip switch 194 are wired in series and the series combination is electrically connected to the trigger input 206 of delay on break timer 196. Both weight-on-wheels switch 79 and trip switch 194 are in a normally open position when the device is not activated. Therefore, both conditions must be met, the breaker 10 must be near the ground and the weight 16 must be lifted to the preselected height, before delay on break timer 196 will be activated to drop the weight 16.

Delay on break timer 196 includes common contact 202 and normally open relay contact 204 electrically connected thereto. Positive voltage from the skid steer is applied to common 202 and normally open contact 204 is connected to the valve solenoid 188 such that when delay on break timer 196 is not triggered, normally open contact 204 is not electrically connected to common contact 202 and therefore, valve solenoid 188 is not activated. When delay on break timer 196 is triggered, normally open contact 204 is driven into contact with common contact 202 thereby supplying electricity to valve solenoid 188 which activates actuator 182 to open position 186 (FIG. 8).

The delay on break timer 196 of the timer circuit 106 in the preferred embodiment is a KSDB 110.6SP solid state delay on break timer (relay timer) available from SSAC. However, it is understood that other suitable timer circuits could be substituted without departing from the spirit and scope of the invention.

Delay on break timer 196 sends power to solenoid 188 for a preselected period of time, preferably the amount of time required for the weight to fall to the paved surface (0.6 seconds in the preferred embodiment). Accordingly, valve 90 remains open during this time as discussed above with regard to FIG. 8. Once the preselected time elapses, normally open contact 204 opens and power ceases to be sent to solenoid 188. This drop cycle shall be discussed further below.

To use the inventive device for breaking a paved surface 101 (FIG. 2 in combination with FIG. 9), it is first attached to a suitable host 20 such as a skid steer or backhoe via mounting bracket 22. Next, the breaker is connected to the host hydraulic supply line 92 and to the host return line 94 (of FIG. 8). The host 20 is then used to position the breaker 10 over the surface to be broken 101 and the breaker 10 is lowered until it is sufficiently close to the ground as determined by weight-on-wheels switch 79, resting on wheels 70. The host hydraulic system is then activated to supply hydraulic fluid under pressure to the breaker through the supply line 92 and to receive hydraulic fluid from the breaker through the return line 94.

Figure 2:
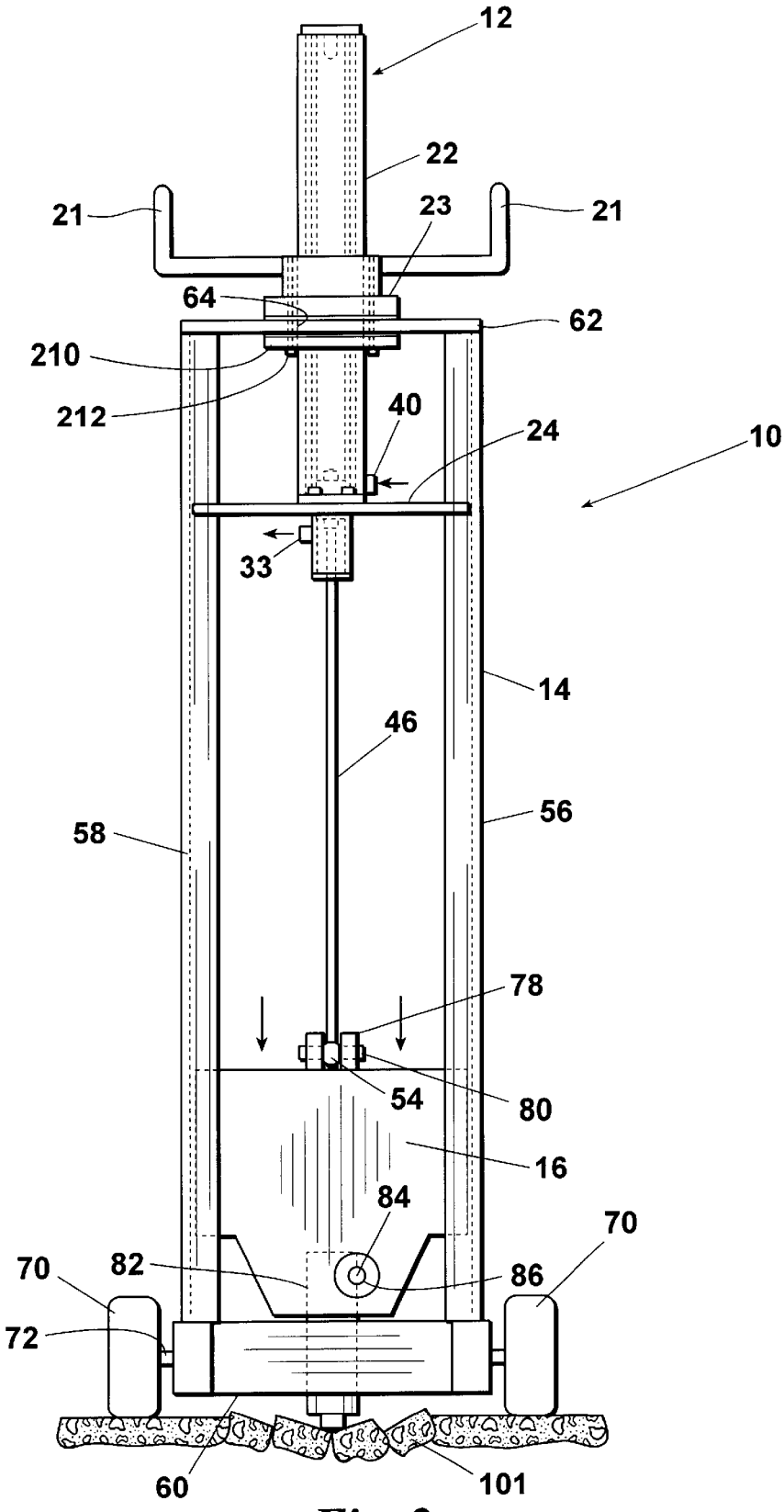
FIG. 2 is an elevational front view of the inventive device for breaking a paved surface showing the weight in a dropped position.

Referring back to FIG. 8, upon activation of the host hydraulic system, valve 90 will be in its closed position 91 so that hydraulic fluid will flow through port 33 into first chamber 32 lifting piston 30 and thereby lifting weight 16. This operation is depicted in FIG. 1. As piston 30 moves upward, hydraulic fluid is forced from second chamber 34 through return line 94 back to the host. Upon weight 16 reaching a preselected height, the trip switch 194 of timer circuit 106 is activated which directs valve 90 to its open position 93 thereby shunting the supply line 92 to the return line 94 and providing a direct path for hydraulic fluid to flow from first chamber 32 to second chamber 34 allowing the weight to rapidly pull the piston down without substantial resistance from the hydraulic fluid being evacuated from first chamber 32. This operation is depicted in FIG. 2. Delay on break timer 196 preferably holds valve 90 in its open position 93 for a slightly greater period of time than is required for weight 16 to drop. Upon expiration of the preselected time period (0.6 seconds in the preferred embodiment), the timer directs valve 90 to its closed position 93 thereby allowing hydraulic fluid to fill first chamber 32 to again lift weight 16. The cycle repeats automatically until the hydraulic system is deactivated by the host (skid steer or backhoe) operator by ceasing the flow of hydraulic fluid or lifting breaker 10.

In the preferred embodiment, the trip switch 194 is wired in series with the weight-on-wheels switch 79 such that the signal indicating the weight 16 has reached its preselected height will not be received by the delay on break timer 196 if the weight of the breaker 10 is not sufficiently close to the ground. Therefore, the weight 16 will be lifted to the top of its range of movement within frame 14 (at this point, the relief valve 180 actuates to relieve the hydraulic fluid pressure) but the weight 16 will not drop until the breaker 10 is properly positioned such that weight on wheels switch 79 (and height trip switch 194) is closed.

An alternate embodiment 150 of the inventive breaker is depicted in FIGS. 12–15. In this embodiment, a hydraulic cylinder 158 is attached to the frame 14. Hydraulic cylinder 158 could be a conventional hydraulic cylinder as shown or a double type hydraulic cylinder as described above. Pulley 152 is attached to cylinder rod 154. One end of cable 156 is attached to pulley bracket 159 and then threaded over pulley 160, back around pulley 152, and over pulleys 162 and 164. The remaining end of cable 156 is attached to clevis 166 which is pivotally attached to bracket 78 on weight 16 with clevis pin 80. This pulley and cable arrangement results in a motion amplifier wherein any movement of the rod 154 results in a three times greater movement of the weight 16 thereby reducing the required stroke length of hydraulic cylinder 158 to achieve a given lift distance of weight 16.

Figure 12:
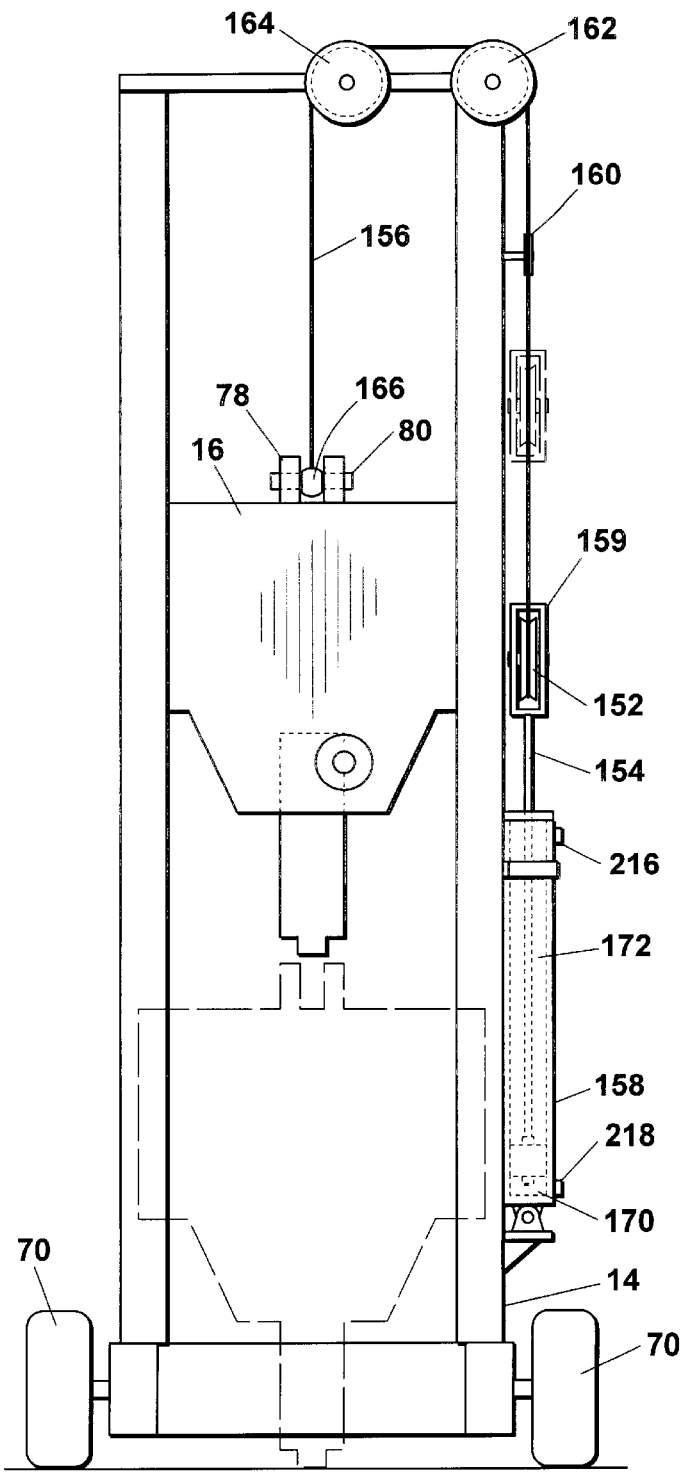
FIG. 12 is an elevational front view of an alternate embodiment 150 of the device for breaking a paved surface shown with the weight 16 in a lifted position with the dropped position shown in phantom.
Figure 13:
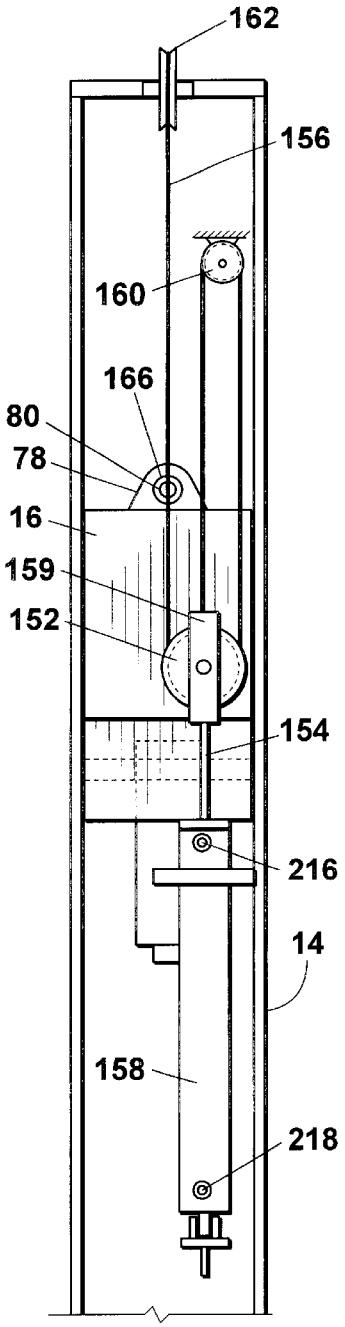
FIG. 13 is an elevational side view of alternate embodiment 150 of the device for breaking a paved surface shown with the weight 16 in a lifted position.
Figure 14:
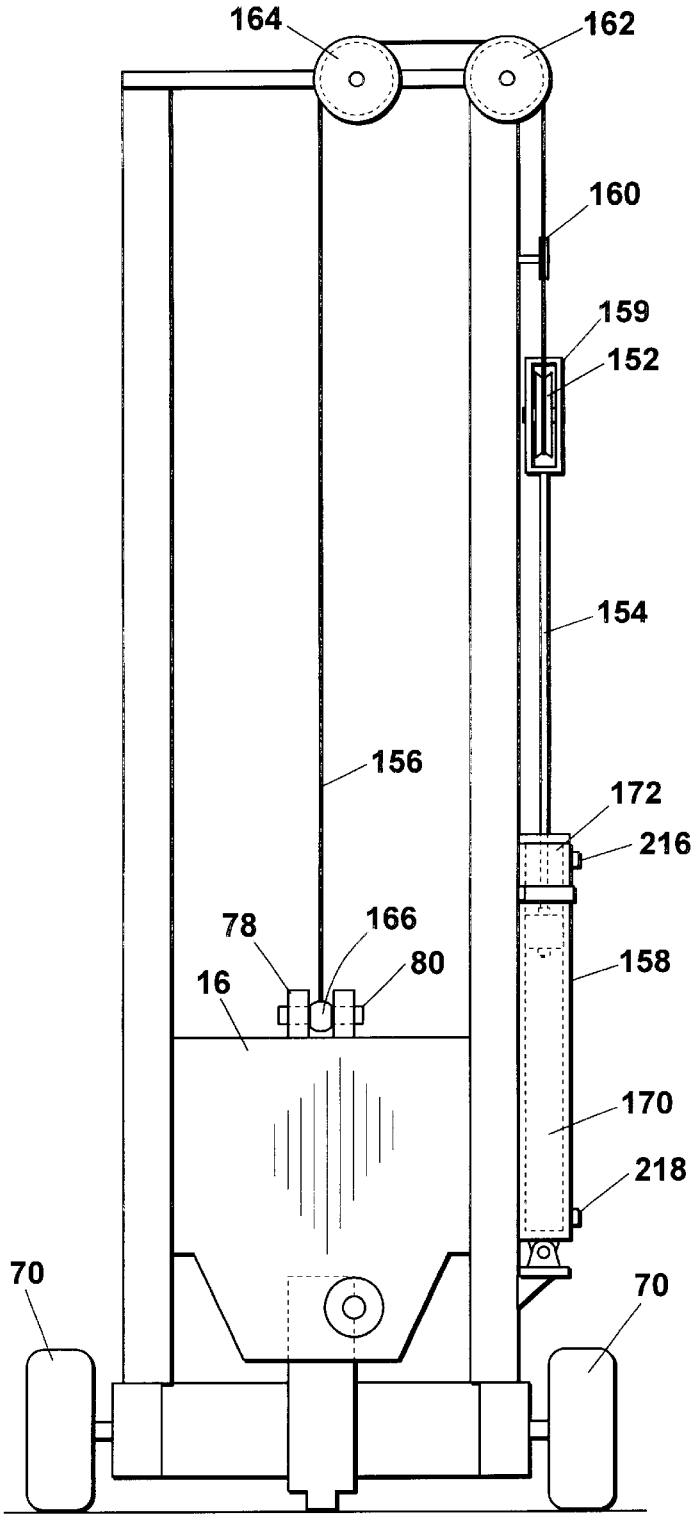
FIG. 14 is an elevational front view of alternate embodiment 150 of the device for breaking a paved surface shown with weight 16 in a dropped position.
Figure 15:
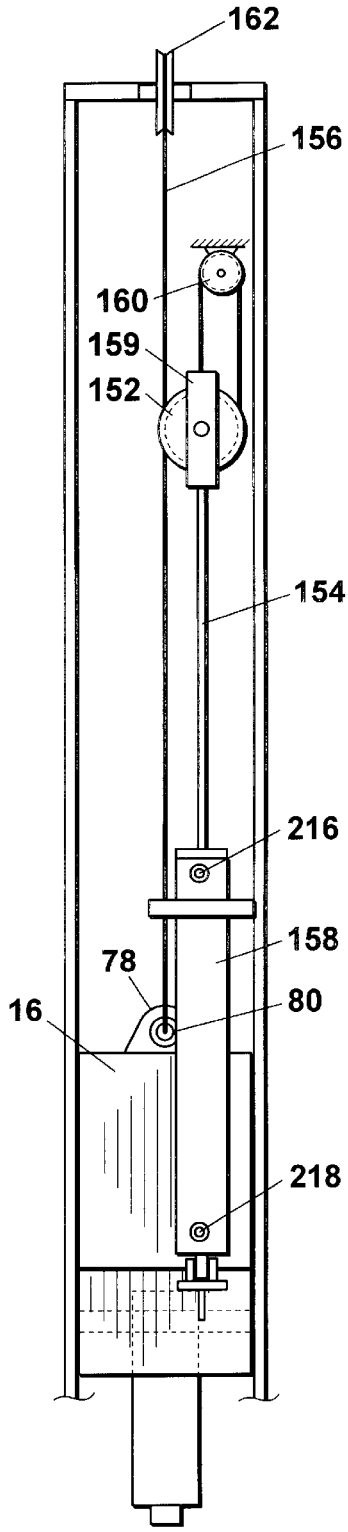
FIG. 15 is an elevational side view of alternate embodiment 150 of the device for breaking a paved surface shown with weight 16 in a dropped position.

In operation, hydraulic fluid is pumped into first chamber 172 through port 216 of hydraulic cylinder 158 pushing the piston downward to lift weight 16 and expel fluid from second chamber 170 through port 218. FIGS. 12 and 13 depict embodiment 150 with the weight 16 shown in a partially lifted position with cylinder rod 154 driven to a retracted position. In this position pulleys 152 and 160 have a relatively large separation. When weight 16 is lifted to a preselected height, valve 90 (FIG. 8) is directed to its open position 91 allowing hydraulic fluid to flow directly from second chamber 170 into first chamber 172 thereby allowing the weight to drop. FIGS. 14 and 15 depict embodiment 150 with the weight 16 shown in its dropped position with cylinder rod 154 in an extended position. In this position, pulleys 152 and 160 are relatively close together.

It will be apparent to those skilled in the art that while the regenerative hydraulic cylinder arrangement is advantageous to embodiment 150, similar results could be achieved with a 3-way hydraulic valve which will direct fluid to and from the host transport rather than directly into the opposite chamber. However, there would be high pressure losses in host piping and greater restriction to the piston, and thereby the weight, falling.

As will be further understood by those skilled in the art, although embodiment 150 of the inventive breaker has been explained with reference to movement amplifier which provides three times the movement of the weight as that of the cylinder rod, there are numerous arrangements of pulleys and cables which would provide satisfactory operation of the breaker with a wide range of movement amplification, including fractional values of thereof.

As will be understood by those skilled in the art, although the preferred embodiments of the inventive apparatus 10 and 150 have been described as incorporating a single hydraulic cylinder, the inventive apparatuses could optionally utilize two, three, or more hydraulic cylinders. Further, although the hydraulic cylinder is herein described as a double cylinder, many variations could be utilized in the present invention including a conventional, off-the-shelf hydraulic cylinder.

As will also be understood by those skilled in the art, although the inventive apparatus has been described with reference to a height adjustment system utilizing a hydraulic cylinder assembly including an adjustment nut threaded over a hydraulic cylinder having a threaded outside surface, the height adjustment system could achieve similar results in a number of ways including a rack and pinion mechanism, a series of vertical apertures with a retaining pin, or any other similar mechanism.

As also will be understood by those skilled in the art, although the above-described preferred embodiment of the inventive apparatus has been explained with reference to a single weight, any number of weights could be employed in the present invention.

It will be further understood by those skilled in the art that the inventive apparatus can be employed with generally any type of host equipment which includes a hydraulic and electrical power supply.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A device for attachment to a host including a hydraulic power supply conveying hydraulic fluid through a supply line and a return line comprising:

(a) a hydraulic system including:

(a)(i) at least one regenerative type hydraulic cylinder having a first chamber, a second chamber, and a piston separating said first chamber and said second chamber;

(a)(ii) said first chamber being in fluid communication with the supply line and said second chamber being in fluid communication with the return line;

(a)(iii) said first chamber being in fluid communication with said second chamber; and (a)(iv) at least one valve capable of actuation between a first position and a second position wherein when said at least one valve is in said first position, the hydraulic fluid flows from the supply line to said first chamber and from said second chamber to the return line and when said at least one valve is in said second position, the hydraulic fluid flows from said first chamber to said second chamber;

(b) a frame supporting said hydraulic cylinder; and (c) at least one weight capable of travel relative to said frame in response to actuation of said at least one valves.

2. The device for attachment to a host of claim 1 wherein said piston is capable of movement within said at least one regenerative type hydraulic cylinder;

a rod connected to said piston such that a movement of said piston results in corresponding movement of said rod;

said at least one weight being operably supported from said rod such that movement of said rod results in movement of said at least one weight relative to said frame.

3. The device for attachment to a host of claim 1 further comprising:

(d) at least one pivotable joint wherein said hydraulic cylinder is operably attached to said at least one weight by said at least one pivotable joint.

4. The device for attachment to a host of claim 3 wherein said pivotable joint includes:

(d)(i) at least one cable.

5. The device for attachment to a host of claim 1 further comprising:

(d) a motion amplifier wherein said hydraulic cylinder is operably attached to said at least one weight by said motion amplifier.

6. The device for attachment to a host of claim 5 wherein said motion amplifier includes:

(d)(i) a cable having at least a first end wherein said first end is attached to said weight; and (d)(ii) at least one pulley wherein said cable traverses said at least one pulley such that a movement of said hydraulic cylinder results in a movement of said at least one weight of at least the same distance of said movement of the hydraulic cylinder.

7. The device for attachment to a host of claim 1 further comprising:

(d) a cable having a first end, said first end attached to either said at least one weight or said hydraulic cylinder; and (e) at least one pulley wherein said cable traverses said at least one pulley such that a movement of said hydraulic cylinder results in a movement of said at least one weight.

8. The device for attachment to a host of claim 1 wherein said hydraulic system is a closed system.

9. The device for attachment to a host of claim 1 further comprising:

(d) a sensor which produces binary states such that when said weight is below a preselected height, said sensor will produce a first binary state and when said weight is lifted to said preselected height, said sensor will produce a second binary state.

10. The device for attachment to a host of claim 9 further comprising:

(e) a least one timer including an input for receiving said binary states from said sensor, wherein when said timer receives said first binary state, said timer directs said valve to its said first position and when said timer receives said second binary state, said timer directs said valve to its said second position for a preselected period of time and thereafter, upon receiving said first binary state, said timer again directs said valve to its said first position.

11. The device for attachment to a host of claim 1 wherein said at least one regenerative type hydraulic cylinder includes a double cylinder arrangement.

12. The device for attachment to a host of claim 1 wherein said at least one regenerative type hydraulic cylinder includes a concentric double cylinder arrangement.

13. A system for ensuring proper positioning of a device for breaking a paved surface for attachment to a skid steer or backhoe including a hydraulic power supply conveying hydraulic fluid through a supply line and a return line, comprising:

(a) a frame;

(b) a hydraulic system including:

(b)(i) a hydraulic cylinder having a rod; and (b)(ii) a valve having at least a first position and a second position;

(c) a weight slidably retained in said frame, said weight being capable of travel within said frame in response to movement of said rod;

(d) a ground contacting member attached to said frame; and (e) a sensor for sensing contact between the ground and said ground contacting member such that said sensor produces an output indicative of said contact, wherein, when said valve is in said first position, hydraulic fluid is directed from said supply line to said hydraulic cylinder thereby moving said weight to an upper position, wherein, when said valve is in said second position, hydraulic fluid is allowed to flow from said hydraulic cylinder thereby allowing said weight to fall to a lower position; and wherein, when said output indicates that said ground contacting member is not contacting the ground, said valve is directed to one of said first or second positions.

14. The system of claim 13 wherein said hydraulic cylinder includes a double cylinder arrangement.

15. The system of claim 13, further including:

a cable having at least a first end wherein said first end is attached to said weight; and at least one pulley wherein said cable traverses said at least one pulley such that a movement of said hydraulic cylinder results in a movement of said weight of at least the same distance of said movement of the hydraulic cylinder.

* * * * *